United States Patent [19]

Merkel

[11] 4,418,757

[45] Dec. 6, 1983

[54] STORAGE RACK STRUCTURAL SPRINKLER SYSTEM

[75] Inventor: Jerome P. Merkel, Plymouth, Minn.

[73] Assignee: United Sprinkler, Inc., Hamel, Minn.

[21] Appl. No.: 213,855

[22] Filed: Dec. 8, 1980

[51] Int. Cl.[3] ..... A62C 37/00

[52] U.S. Cl. ..... 169/54; 239/208; 285/64; 248/74 R

[58] Field of Search ..... 169/54, 16, 5, 37; 239/209, 208; 211/134, 13, 60; 285/61, 64, 197, 373, 369; 248/62, 68 R, 69, 74 R; 52/638, 637, 633; 182/51, 52

[56] References Cited

U.S. PATENT DOCUMENTS

| | | | |
|---|---|---|---|
| 1,517,544 | 12/1924 | Draver | 285/61 |
| 2,146,067 | 2/1939 | Graham | 285/64 |
| 2,519,203 | 8/1950 | Stoecklin | 285/61 |
| 2,550,001 | 4/1951 | Button | 248/74 R |
| 2,670,222 | 2/1954 | Dragon | 285/61 |
| 3,129,920 | 4/1964 | Stillwagon | 285/373 |
| 3,208,534 | 9/1965 | Kazarian | 169/54 |
| 3,539,108 | 11/1970 | Lillibridge | 239/209 |
| 3,626,487 | 12/1971 | Seiz | 169/54 |
| 3,727,694 | 4/1973 | Dudzik | 169/54 |
| 3,802,574 | 4/1974 | Weider | 169/54 |
| 4,012,470 | 3/1977 | Thayer | 248/24 R |
| 4,039,210 | 8/1977 | Wood et al. | 285/373 |
| 4,047,570 | 9/1977 | Murk | 169/16 |
| 4,310,184 | 1/1982 | Campbell | 285/373 |

FOREIGN PATENT DOCUMENTS

| | | | |
|---|---|---|---|
| 358685 | 4/1938 | Italy | 285/61 |

*Primary Examiner*—Joseph J. Rolla
*Assistant Examiner*—Kenneth Noland
*Attorney, Agent, or Firm*—Peterson, Palmatier, Sturm, Sjoquist & Baker, Ltd.

[57] ABSTRACT

An improved sprinkled warehouse stacker rack in which the sprinkler system is an integrated portion of a rack structure. A plurality of load bearing side frame members of any given heighth are operably interconnected to provide a stable structure having a plurality of load receiving cells. A sprinkler system comprised of a plurality of pipe members, each having a length, such that when assembled to connect a pair of side frame members, a load receiving cell of a predetermined width is created. A clamp for providing limited tri-axial movement of a sprinkler pipe is disposed on each of the side frame members and is adapted to co-act with the end of a sprinkler pipe to operably engage the same and to horizontally space the side frame members while permitting vertical and horizontal misalignment to accommodate normal construction tolerances. The clamp also provides for disposing the ends of the pipes in adjacent spaced-apart relationship to receive and be sealably engaged by a sprinkle head or connector fitting to form a sprinkler system on the completed rack. The clamps are also configured and arranged to provide integrity to the sprinkler system by shielding the connections at the ends of the individual pipes from damage due to accidental contact.

9 Claims, 11 Drawing Figures

STORAGE RACK STRUCTURAL SPRINKLER SYSTEM

FIELD OF THE INVENTION

This invention relates generally to warehousing and storage systems and is more particularly directed to the stacker type of system in which a number of cubicles are provided in rows and columns in spaced-apart aisles so that access to the cubicles for the insertion and removal of materials to be stored or removed may be facilitated in either a manual, semi-automated or fully automated facility. My invention is further directed to providing adequate fire protection through the incorporation of elements that are operative, in a normal structural sense to form a part of the cubicle structure, known as a stacker rack, and to be operative to supply extinguishing fluid at proper locations, in the event of a fire, to protect the materials stored in the cubicles in the rack.

DESCRIPTION OF THE PRIOR ART

Typical examples of the prior art presently known may be seen in U.S. Pat. Nos. 3,520,345 and 3,539,108 issued to Duane J. Lillibridge, et al. July 14, 1970 and Nov. 10, 1970 respectively for Storage Rack and Sprinker Arrangement; and U.S. Pat. No. 3,626,487 issued to Edward A. Seiz Dec. 7, 1971 for Fire and Vermin Resistant Storage Structure having Fail-safe features.

The Lillibridge patents relate to a stacker rack in which a plurality of columns of a rack structure are comprised of vertical hollow members sealed at both ends and provided with sprinkler heads disposed at predetermined locations and are further connected to a source of fire extinguishing fluid.

The Seiz patent refers to a conventional stacker rack structure having releasable locking features for horizontal beams disposed between vertical columns and includes a vertical pipe for fire extinguishing fluid that is mounted in the vertical columns. Sprinkler heads may be mounted on the pipe which may also be connected to further horizontally disposed sprinkler pipes having appropriate sprinkler heads in spaced-apart relationship.

Other known prior art arrangements include multitudinous add-on types of sprinkler systems such as may be found within and without warehousing or other building facilities and which are disposed on suitable hangers and connected through suitable piping to supply fire extinguishing fluid to appropriately disposed sprinkler heads.

SUMMARY OF THE INVENTION

A general object of my invention is to provide a unitary structure having improved mechanical and fire safety characteristics that is comprised of a unique combination of elements as will be more fully explained below.

It is an object of my invention to provide a storage rack system having an integrated fire sprinkler feature and which is comprised of modular elements having prefabricated vertical side member elements inter-connected through novel and improved connecting means to and through horizontally disposed pipes which also provide a sprinkler system to create an improved structure that requires less design time, material cost and set up time.

Another object of my invention is to provide a method of creating a sprinkled storage rack structure having the features set forth above.

Briefly, my invention contemplates the provision and fabricating of a plurality of side frame elements having appropriately horizontally spaced-apart vertical columns to which are rigidly attached horizontally extending vertically spaced-apart load receiving pads or rails, which, together with appropriately disposed diagonal bracing members, form a vertically disposed portion of a rack structure that is of a rigid nature with respect to the front and back portions. A plurality of novel clamping means are positioned at vertically spaced, complementary disposed locations on the vertical columns for receiving and engaging the ends of horizontally disposed pipe members. The ends of the pipe members are configured to be received and be engaged by complementary configured portions of the clamping means so that when the pipes are horizontally disposed between the complementary positioned clamping means on the vertical columns, where by a three dimensional stacker rack structure is formed in which load receiving cubicles are defined by opposed load receiving pads at corresponding vertically spaced positions.

The clamping means are configured to co-act with the ends of the sprinkler pipes to permit a limited degree of triaxial freedom of motion to allow for variations in a structure occasioned by normal deviations from design tolerances in an actual installation in a, for example, warehousing facility. Adjacent the ends of the sprinkler pipes are disposed in spaced-apart relationship for receiving a connector that may also be adopted to mount a sprinkler head. For this purpose, the clamping means are provided with horizontally spaced-apart pipe engaging portions adapted to receive the above-recited ends of the sprinkler pipes and the ends of the sprinkler pipes are similarly adapted to be removably, sealably engaged by the connector devices. It may now be seen that a structure is provided with a plurality of vertically spaced-apart cubicles and includes, as an integral portion of the structure, a plurality of continuous horizontally extending pipe members that are connected to provide a plurality of appropriately disposed, protected sprinkler heads and to be connected to a source of fire extinguishing fluid under pressure.

The modular type of construction is easily adapted to stacker systems of a given height and width, any desired number of load receiving cubicles and requires only that the side frame members be dimensioned to accomplish the design objectives and further requires a plurality of sprinkler pipe members of predetermined length.

BRIEF DESCRIPTION OF THE DRAWINGS

FIG. 1 is a sectional side elevation view of a stacker rack assembly taken along section line 1—1 on FIG. 2;

FIG. 8 is a further view of the apparatus shown in FIGS. 6 and 7 with portions of the elements shown in phantom outline;

DESCRIPTION OF THE ILLUSTRATED EMBODIMENT

Figures 2, 7:
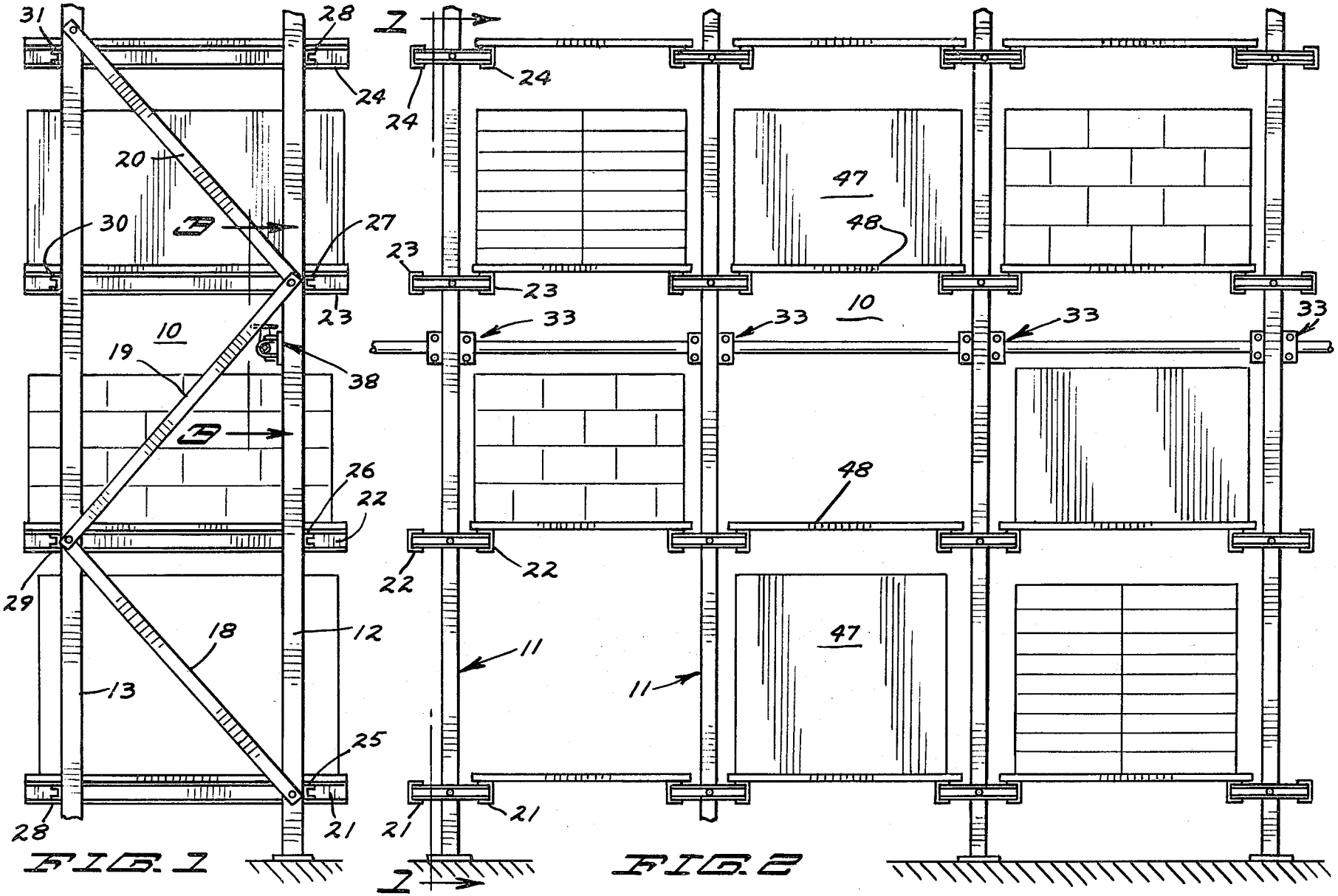
FIG. 2 is a front elevation view of a portion of a stacker rack assembly embodying the principles of my invention.
FIGS. 7 and 8 are partly sectional fragmentary views of the illustration of FIG. 6 with portions removed or shown in phantom outline.
Figure 3:
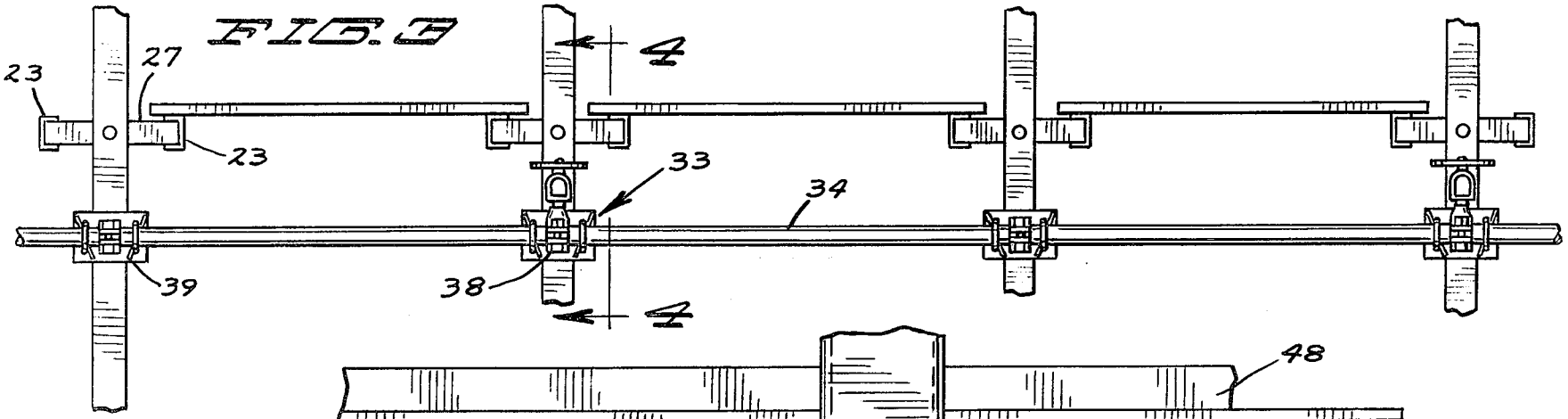
FIG. 3 is an enlarged fragmentary elevational sectional view of a portion of FIG. 1 taken along section line 3—3.
Figure 4:
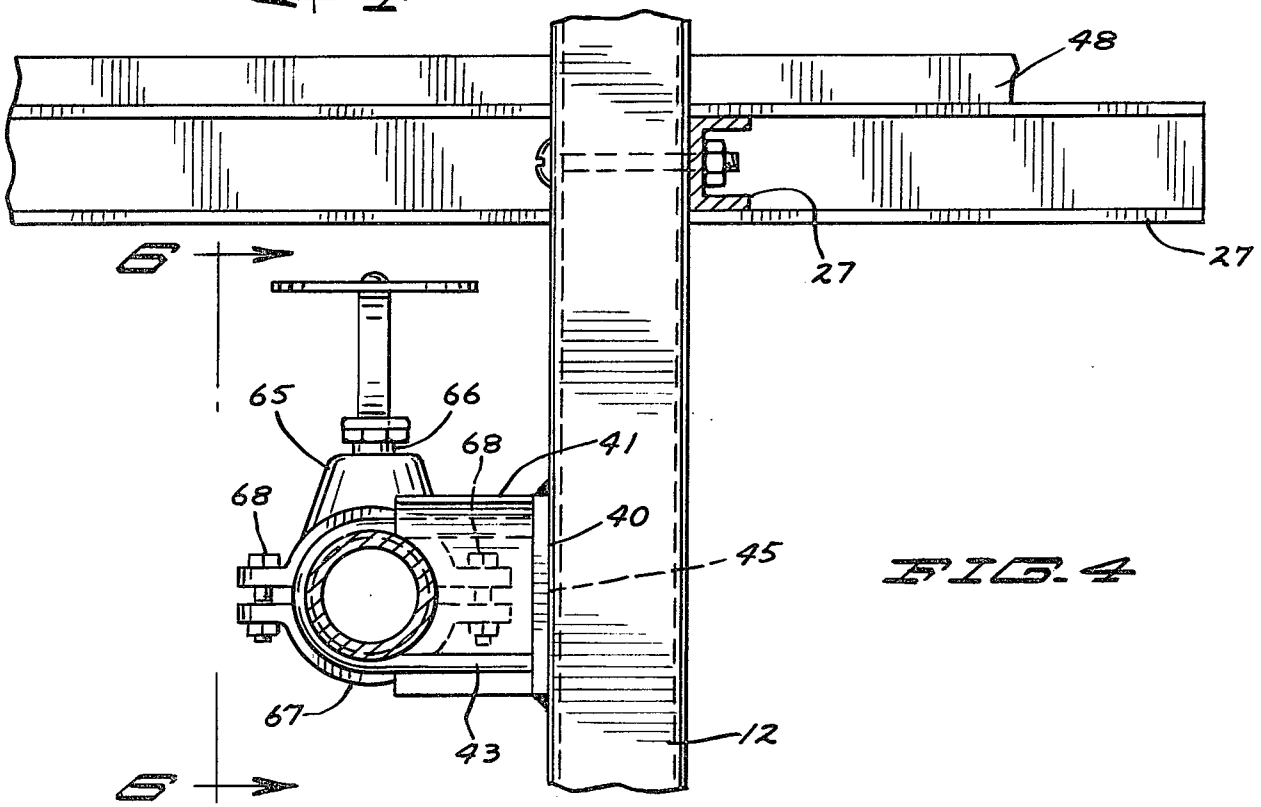
FIG. 4 is an enlarged fragmentary side elevational view of a portion of the illustration of FIG. 3 taken along section line 4—4.
Figure 5:
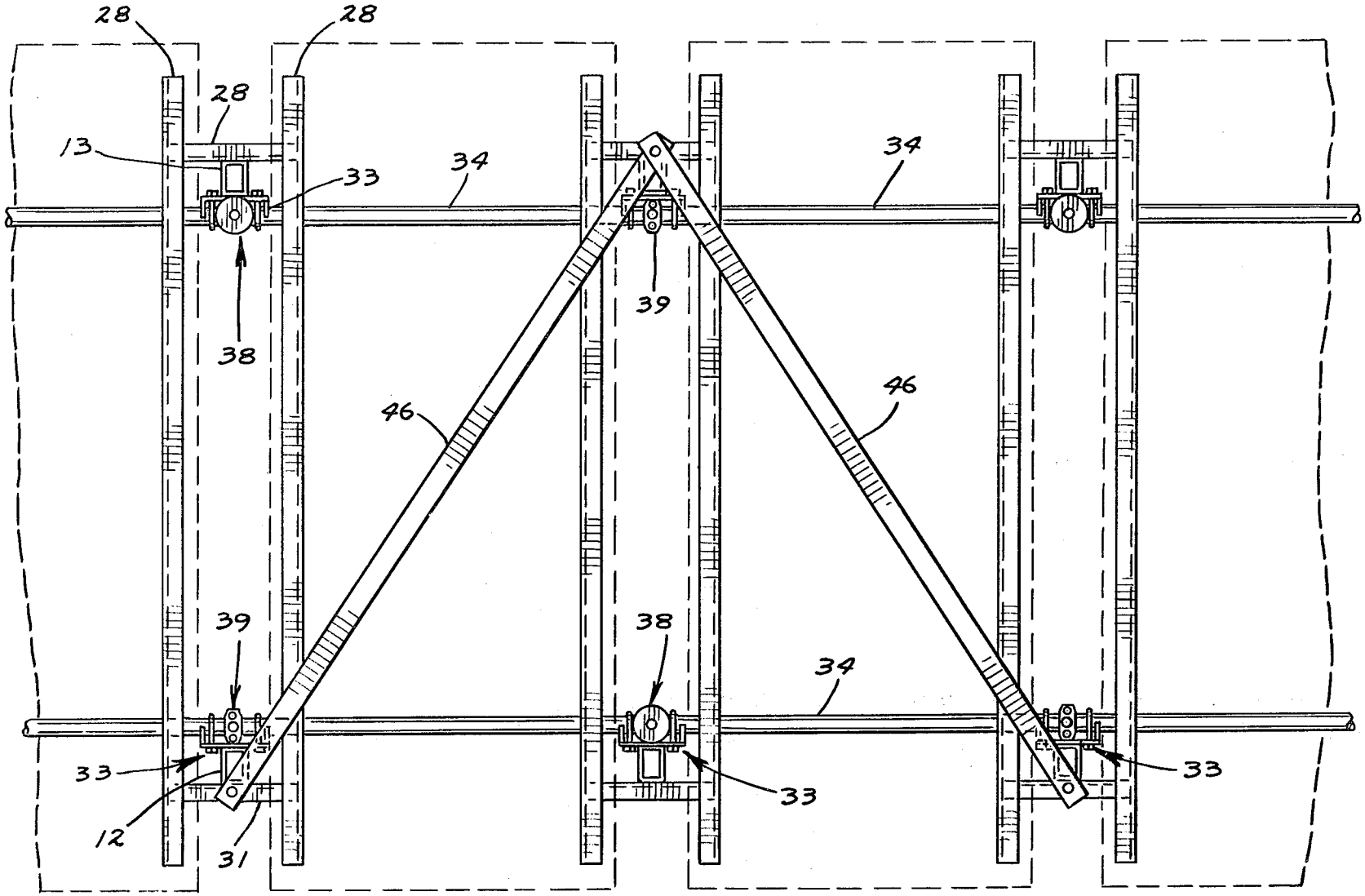
FIG. 5 is an enlarged fragmentary top plan view of the structure shown in FIGS. 1–4.
Figure 6:
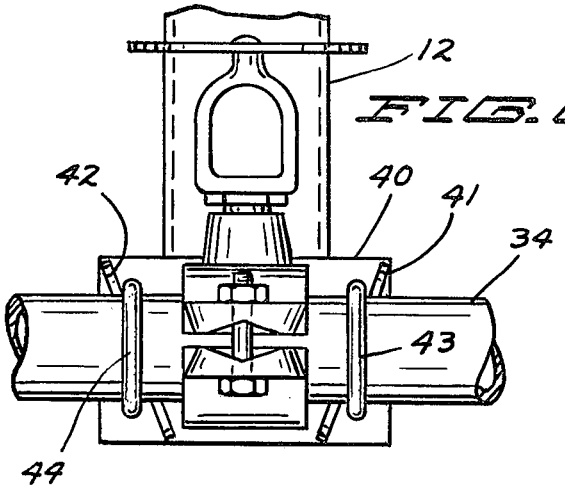
FIG. 6 is an enlarged fragmentary rear elevational view of a portion of the apparatus shown in FIGS. 1–5 taken along section lines 6—6 in FIG. 4.
Figure 7:
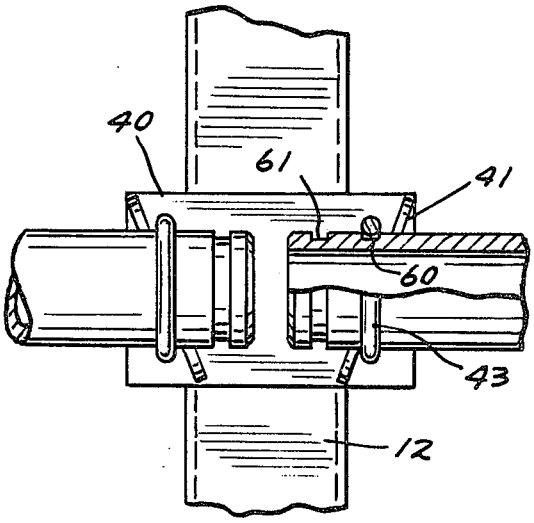
Figure 8:
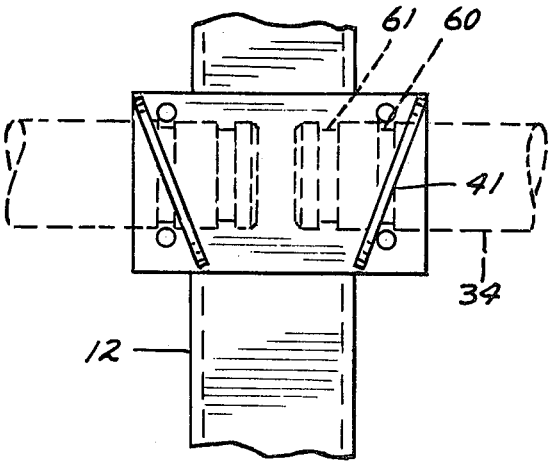

Referring to FIGS. 1–8, inclusive, of the drawings, a stacker rack is indicated generally by reference character 10 and includes a plurality of side frame members 11, a plurality of sprinkler pipe sections 34 and 35 and a plurality of sprinkler head connectors 38 and connectors 39.

Side frame members 11 are shown comprised of front and rear vertical columns 12 and 13 that are horizontally spaced-apart, front to rear, commensurate with the size and shape of loads to be received in the cubicles formed between adjacent portions in the stacker rack structure. Columns 12 and 13 are interconnected by pairs of load pads, or rails, 21, 22, 23 and 24 that are in turn disposed on and connected to a plurality of horizontal front brackets 25, 26, 27 and 28 and a like plurality of horizontal rear brackets 29, 30, 31 and 32, each mounted, as by welding, on said columns in complementary vertically spaced apart relationship. Columns 12 and 13 are also interconnected through diagonal members 18, 19 and 20, each attached to columns 12 and 13 through suitable fastening means to provide a rigid structure of appropriate size and shape to form, when combined with another like shape and configured side frame member, a plurality of vertically spaced-apart load receiving cubicles.

A plurality of clamp means 33 are disposed in horizontal registration on columns 12 and 13 and may be positioned on the inside or outside of the columns. Clamp means 33 includes a base 40 adapted to be mounted on either column 12 or 13 through a suitable bolt 45 or, for example, by welding. Disposed upon and rigidly connected to base 40 of clamp means 33, are a pair of horizontally spaced-apart V shaped pipe engaging members 41 and 42 which are disposed at an angle to the vertical axis of base 40 and columns 12 and 13 as seen on FIGS. 6, 7 and 8. Clamp means 33 also includes a pair of U bolt members 43 and 44, extending through suitable apertures in base 40 positioned on opposite sides of V shaped pipe receivers 41 and 42, respectively, for purposes of engaging grooves 60 at the ends of sprinkler conduit pipes 34 and 35 as set forth below.

Sprinkler conduit pipes 34 and 35 are provided with spaced-apart outwardly opening bracket and connector grooves 60 and 61, respectively, as shown on FIGS. 6–11. Grooves 60 and 61 may be formed, as by rolling, or any other suitable method and the spacing from the ends of sprinkler conduit pipes 34 and 35 and between adjacent grooves 60 and 61 is determined by the characteristics of sprinkler head connectors 38 or 39.

Sprinkler head connector 38 is shown in the form of a threaded outlet saddle tee of the internally grooved type and, dependent upon the location in a system, could either be a plain connector 38, or a closed end connector. One such commercially available connector is known by the trade name "Vitaulic." Referring to FIG. 9 of the drawings, a sprinkler head connector 38 is shown comprised of a top clamp 65, having a threaded outlet 66, and a bottom clamp 67 that is connected to the top clamp 65 through suitable bolts, identified by reference character 68. Suitable grooves (not shown) on the inside of top and bottom clamps 65 and 67, are configured to co-act with grooves 61 in sprinkler conduit pipes 34 and 35 and assembly may be completed using appropriate sealing means, for example, O-rings.

Figure 11:
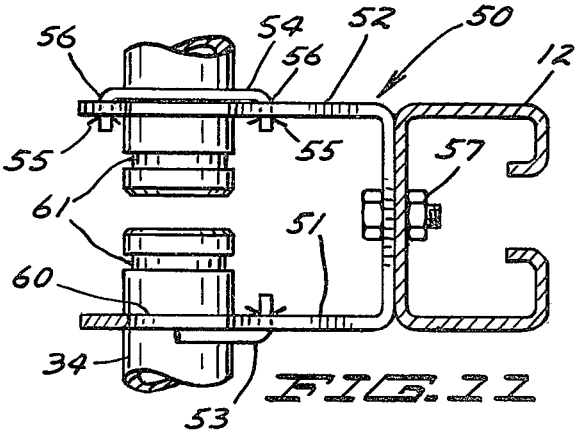
FIG. 11 is a plan, partly sectional view of the apparatus shown in FIGS. 9 and 10 with a portion of the apparatus omitted for purposes of illustration.
Figure 9:
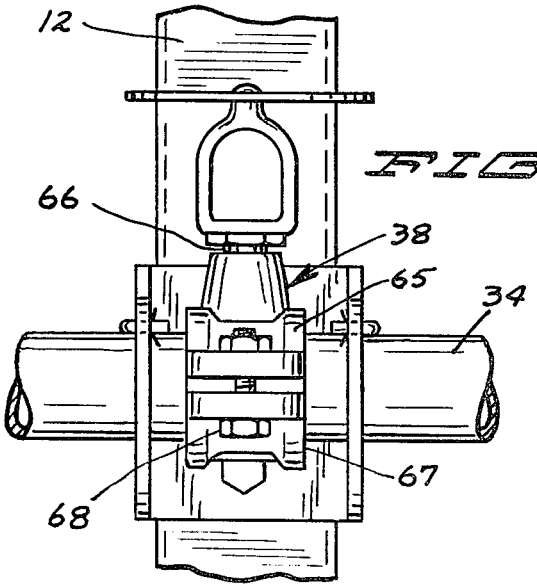
FIG. 9 is an enlarged rear elevational view of a second embodiment of the apparatus shown in FIG. 6–8.
Figure 10:
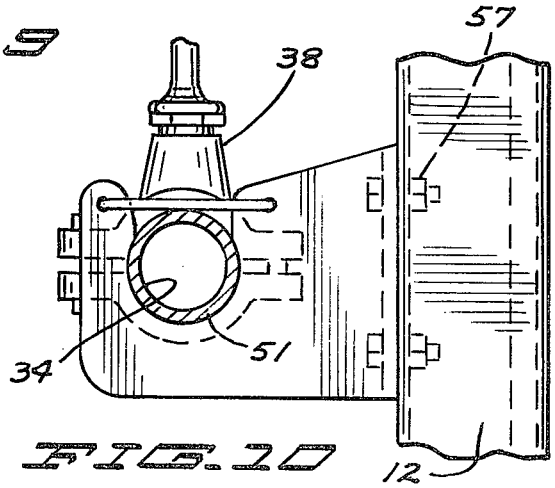
FIG. 10 is a side elevational view, partly in section, of the illustration of FIG. 9.

Referring to FIGS. 9, 10 and 11 of the drawings, a second embodiment of clamp means 33 is shown having a base 50 including two laterally extending outwardly opening U-shaped receiver portions 51 and 52 that are spaced apart and adopted to receive grooves 60 in pipes 34 and 35. Each of the U-shaped receiver portions 51 and 52 is provided with apertures 56 disposed adjacent the open end of the U and are adapted to receive locking members 53 and 54 respectively that are shown held in position by suitable locking pins 55.

It may thus be seen that my modular sprinkled storage rack system, when assembled, is comprised of a plurality of horizontally spaced-apart side frame members 11 that are inter-connected and held in position by a plurality of horizontally disposed pipe members 34 and 35, the ends of which are disposed in clamp means 33 and inter-connected either to each other or to a suitable source of fluid through connectors 38 and 39.

It is anticipated that once the design size requirements have been determined, a plurality of side frame members may be fabricated to include a necessary number of load pads or rails and clamp means, disposed at elevations commensurate with good fire protection practice, the necessary numbers of conduit pipes prepared to the desired length, the last named elements erected and fastened together, the desired connectors for sprinkler heads and other purposes installed.

It may thus be seen that, through the use of my structure and method, considerable time and cost is saved while reducing the complexity of a structure while retaining the flexibility desirable for a wide range of installations of differing sizes and shapes.

I claim:

1. A fire protection and structural storage rack system which supports vertically spaced apart load support means, comprising in combination;

a plurality of like, horizontally spaced apart vertical side frame members;

a plurality of open ended sprinkler conduits disposed in horizontal axial alignment intermediate adjacent vertical side frame members, each of said plurality of sprinkler conduits having ends which are rigidly and structurally connected to and at said vertical side frame members in cooperable supporting relationship with said vertical side frame members to form said storage rack system for supporting the vertically spaced apart load support means while said ends of adjacent sprinkler conduits are in axially spaced apart relationship at said vertical side frame members; and fluid coupling means joining each said axially spaced apart ends of said conduits independently of said vertical side frame members.

2. The subject matter of claim 1 in which the rigid and structural connection of the sprinkler conduits to the vertical side frame members includes clamp means disposed on the vertical side frame members for removably receiving and rigidly, structurally engaging said sprinkler conduits.

3. The subject matter of claim 2 in which the clamp means and the ends of the fluid conduits are complementary shaped for lockable engagement therebetween.

4. The subject matter of claim 3 in which the fluid conduits include a groove and the clamp means extend inwardly of said groove.

5. The apparatus of claim 2 in which the clamp means include a shaped groove receiving portion and a removable member connected thereto and extending into said groove.

6. The subject matter of claim 5 in which the shaped groove receiving portion is disposed at an angle to the longitudinal axis of the fluid conduits.

7. The subject matter of claim 6 in which the removable member is disposed on alternate sides of the shaped groove receiving portion.

8. The subject matter of claim 7 in which the removable member is of substantially "U" shape.

9. The method of constructing a fire protection and structural storage rack system which supports vertically spaced apart load support means comprising the steps of;

assembling a plurality of like, vertically elongated side frame members in complementary horizontally spaced apart disposition and alignment;

providing a plurality of open ended sprinkler conduits of similar length;

forming said storage rack system for the support of the vertically spaced apart load support means by rigidly and structurally connecting said sprinkler conduits in horizontal axial alignment intermediate said vertical side frame members while providing axially spaced apart relationship of the ends of said sprinkler conduits at said vertical side frame members; and connecting fluid coupling means intermediate the axially spaced apart ends of said sprinkler conduits independently of said vertical frame members.

* * * * *